US006094865A

United States Patent [19]

Weeks

[11] Patent Number: 6,094,865

[45] Date of Patent: Aug. 1, 2000

[54] SHUTTER HANDLE LATCH

[75] Inventor: Ian Weeks, Blackfield, United Kingdom

[73] Assignee: AS Fire & Rescue Equipment Limited, United Kingdom

[21] Appl. No.: 09/201,665

[22] Filed: Dec. 1, 1998

[30] Foreign Application Priority Data

Dec. 3, 1997 [GB] United Kingdom ..... 9725547

[51] Int. Cl.[7] ..... E06B 7/086; E06B 9/56

[52] U.S. Cl. ..... 49/87.1; 160/290.1; 292/DIG. 36

[58] Field of Search ..... 49/87, 74.1, 403, 49/141; 160/290.1, 275; 292/87, 202, 203, 121, DIG. 36

[56] References Cited

U.S. PATENT DOCUMENTS

| | | | |
|---|---|---|---|
| 3,942,286 | 3/1976 | Ehret et al. | 49/141 |
| 4,106,239 | 8/1978 | Bancroft | 49/449 |
| 4,313,280 | 2/1982 | Ehret et al. | 49/141 |
| 4,480,676 | 11/1984 | Solomon | 160/290.1 X |
| 5,022,691 | 6/1991 | Clay, Jr. | 292/121 |
| 5,246,054 | 9/1993 | Shepherd et al. | 160/290.1 X |
| 5,342,102 | 8/1994 | Takimoto | 292/228 |

FOREIGN PATENT DOCUMENTS

| | | |
|---|---|---|
| 0 341 174 | 11/1995 | European Pat. Off. . |
| 2113749 | 8/1983 | United Kingdom . |
| 2112850 | 7/1985 | United Kingdom . |
| 2272725 | 5/1994 | United Kingdom . |

*Primary Examiner*—Daniel P. Stodola
*Assistant Examiner*—Hugh B. Thompson
*Attorney, Agent, or Firm*—Hall, Priddy, Myers & Vande Sande

[57] ABSTRACT

A shutter, as used on fire engines, consists of a number of laths (13), which are hingedly connected together and can be drawn across an opening by handle and can be latched in the closed condition by a latch. The handle, which extends across the shutter, being formed by the mounting bracket (12), which is mounted on a lath (13), and the latch member (11) which is hingedly connected to the mounting bracket (12), thereby reducing the number of parts required and the need for separate opening and closing handles. The latch member (11) co-operates with a keeper (18) which is mounted on the structure (10) which surrounds the opening thereby latching the shutter in position.

13 Claims, 3 Drawing Sheets

FIG. 1
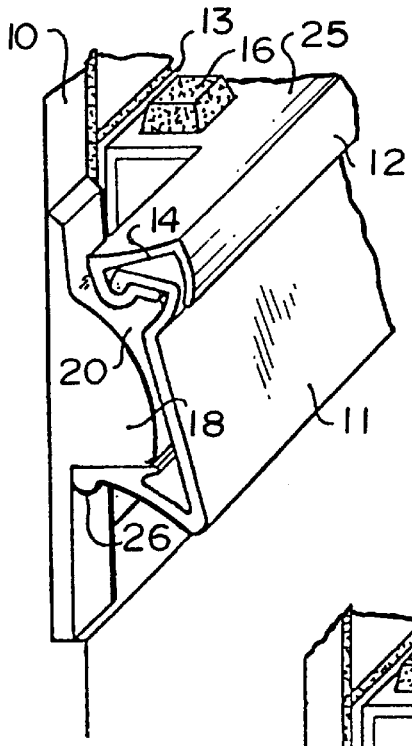
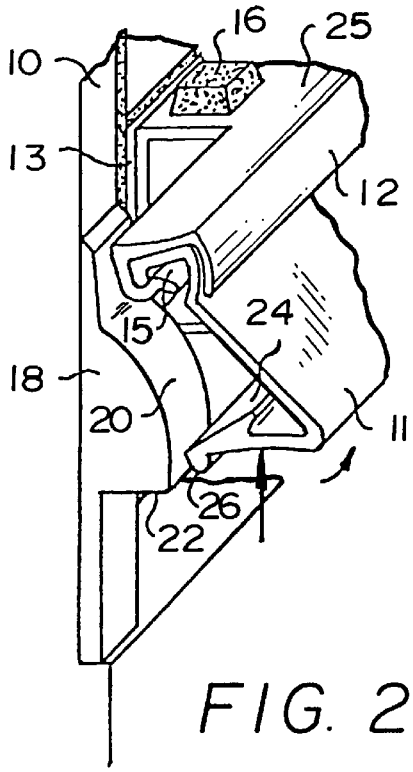
FIG. 2
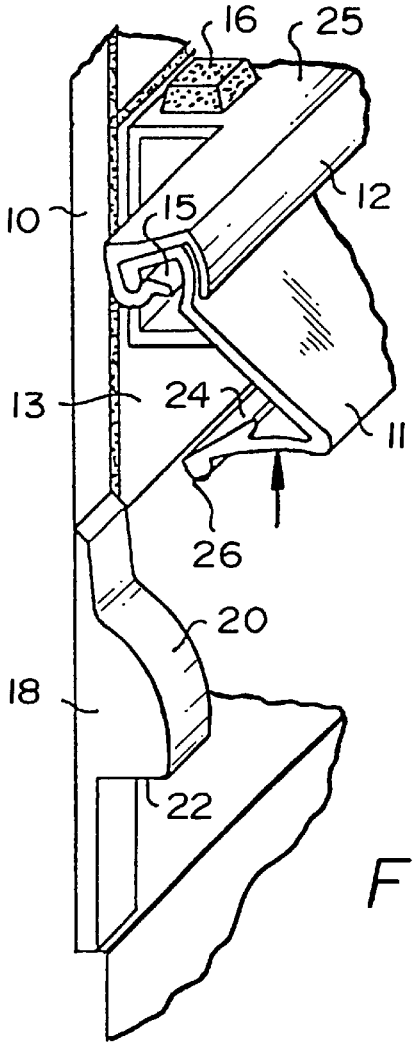
FIG. 3

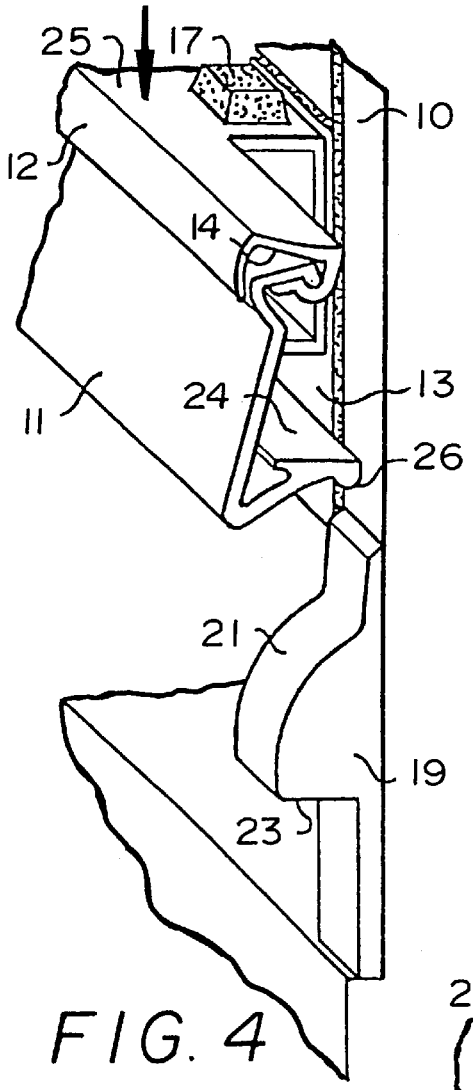
FIG. 4
FIG. 5
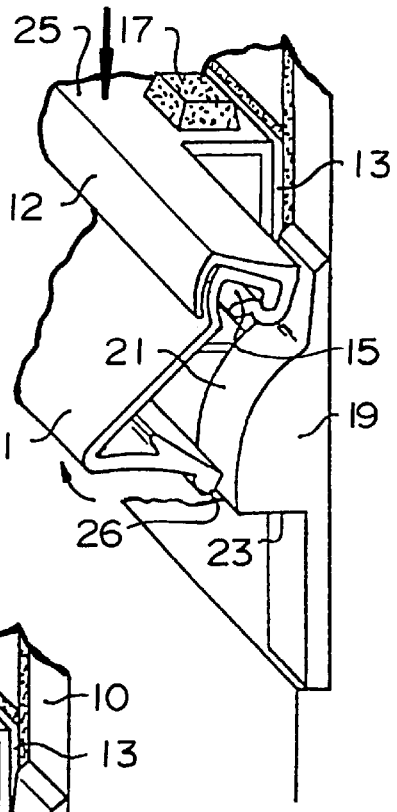
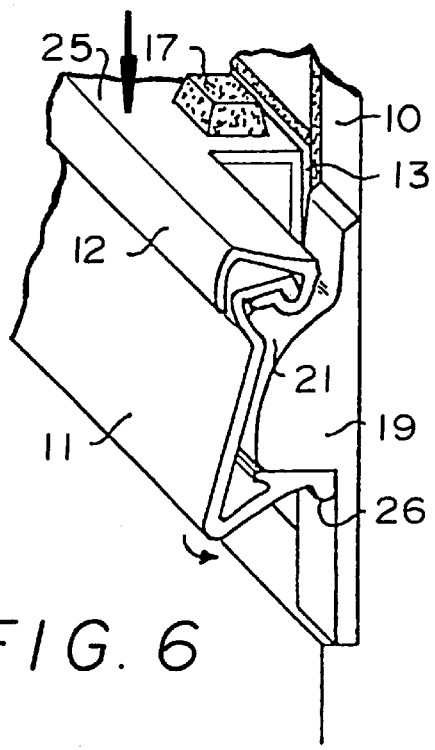
FIG. 6

SHUTTER HANDLE LATCH

This invention relates to shutters and is concerned in particular with a handle by which such a shutter is opened and closed and a latch mechanism by which such a shutter is latched closed.

British Patent Specification No. 2,112,850 discloses a shutter latch mechanism which is operable to release a latch whilst the shutter is held manually against a load which urges it open. It is usual practice for latches of this type to be operated by a handle formed by a bar extending across the front of the shutter; Such latch mechanisms are complex in construction and the handle bars are prone to distortion requiring additional supports along their length. Other forms require separate handles for opening and closing of the shutter.

An object of this invention is to provide a shutter with a combined handle and latch mechanism that is simpler in construction and less vulnerable to distortion and affords access to the latch mechanism when the shutter is closed.

A shutter assembly may include resilient loading means which urge the shutter in the opening direction towards a storage location.

Preferably there is one handle and the handle extends over substantially the full length of the lath upon which it is mounted.

Conveniently the handle is formed by the mounting bracket which forms the upper surface of the handle and is fixed to the lath and, upon which mounting bracket is pivotally mounted the latch member which forms the under surface of the handle. Usually opening movement of the shutter is upwards and wherein the mounting bracket forms stops at its top, the stops being adapted to limit upward movement of the shutter by abutting the structure at the top of the opening.

Each mounting bracket may form a stop surface which limits pivotal movement of the latch member relative to the lath on which it is mounted. There being preferably two stop surfaces formed on said mounting bracket which respectively limit pivotal movement of the latch member in either direction. The handle may comprise a substantially J shaped swinging member which preferably extends laterally to envelop a majority part of the keepers mounted upon the structure one each side of the opening, the swinging member being pivotally mounted upon a respective mounting bracket being hingedly connected together at their co-operating longitudinal edges.

In another embodiment the latch member may substantially envelop a majority part of the mounting bracket in such a manner that the closing force is applied to the upper surface of the latch member which forms the upper surface of the handle.

Specific embodiments of this invention will now be described, by way of example only, and with reference to the accompanying drawings, Of which:

FIG. 1 is a fragmentary view in perspective showing the lower left hand comer of the shutter and the respective handle and latch mechanism when the shutter is latched in its closed position, the latch mechanism being viewed from outside the opening at a location displaced from the opening to the left of the opening;

FIG. 2 is a view similar to FIG. 1 illustrating disengagement of the latch mechanism during initial opening of the shutter;

FIG. 3 is a view similar to FIG. 2 showing the deflection of the latch mechanism by the application of the opening force to it, during opening movement of the shutter;

FIG. 4 is a fragmentary view in perspective showing the lower right hand corner of the shutter, the handle, the respective latch mechanism and keeper as the latch member approaches the keeper during closing movement of the shutter, the latch mechanism being viewed from outside the opening at a location displaced from the opening to the right of the opening;

FIG. 5 is a similar view to FIG. 4 showing initial deflection of the latch mechanism by the keeper during closing movement of the shutter;

FIG. 6 is a similar view to FIGS. 4 and 5 illustrating engagement of the latch mechanism with its keeper to close the shutter;

Figure 7:
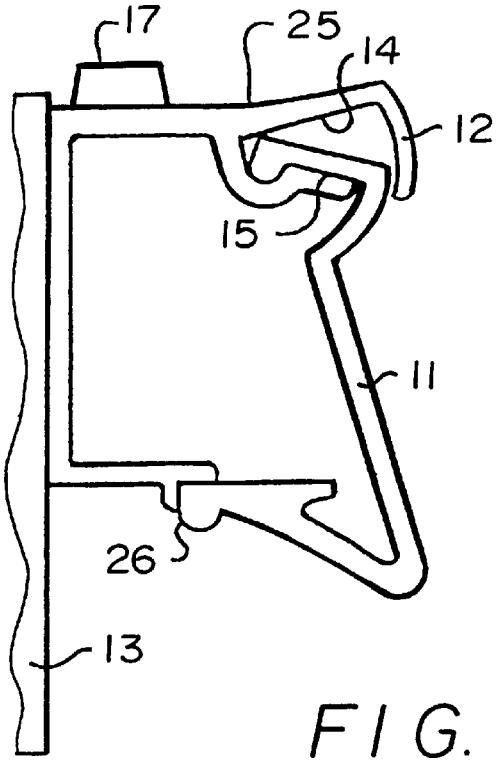
FIG. 7 is a sectional view of the mounting bracket and the latch member viewed from the left hand side of the shutter.

A vehicle such as a fire engine, has an opening which provides access to a storage compartment. The opening is surrounded by a frame 10 (see FIGS. 1 to 6) and is normally closed by a roller shutter.

The roller shutter comprises a plurality of elongate laths, which are hinged together along their longitudinal edges. Any convenient hinge arrangement such as that which is described in British Patent No. 2,113,749, may be used. The lath (not shown) at one end of the shutter is fixed to a storage roller which is mounted within the compartment adjacent to and substantially parallel to the upper edge of the opening. The storage roller is spring loaded in the direction in which it must rotate to draw the shutter across the opening so as to open the opening, the shutter being rapped around the roller as it is so drawn.

A handle is provided on the outer surface of the shutter so that an operator can apply a load assisting the spring to open the shutter or to restrain opening movement of the shutter so that it does not open too quickly and can move the shutter against the spring loading to close it.

FIGS. 1 to 7 show that the handle comprises a latch member 11 which is pivotally mounted on a respective mounting bracket 12 which is secured to the outer surface of the lath 13 of the roller shutter adjacent the respective end of that lath 13. Each mounting bracket 12 forms stop surfaces 14 and 15 which respectively limit upward and downward movement of the latch by abutment therewith of the respective latch member 11. Hence there is always a clearance between the lath member 11 and the lath 13. Each mounting bracket 12 also has an upstanding portion which forms a stops 16, 17 at its top.

Each latch member 11 has a complex geometrical shape for reasons which will be explained.

Each latch member 11 is in a vertical plane which also contains a respective keeper 18, 19 which are fixed to the frame 10 alongside the opening. Each keeper 18, 1 9 projects outwardly from the frame 10 parallel to the edge of the opening. Its upper surface forms a ramp 20, 21 which slopes downwardly and outwardly from the frame 10. Each keeper 18, 19 forms a bight 22,23 below the ramp 20,21. The horizontal depth of the bight 22, 23 corresponds to the respective stop surface 24 of the latch member 11.

The geometrical form of each latch member 11 is such that, when the latch member 11 abuts the stop surface 15 that limits downward movement of the latch member 11, the stop surface 24 is in horizontal alignment with the respective bight 22, 23, each stop surface 24 is located within the respective bight 22, 23 (as shown in FIG. 1) by gravity or by spring means, whereby the shutter is latched against upward movement by that projecting portion of each keeper that extends across and above the respective stop surface 24.

In order to close and latch the shutter, the operator places their fingers onto the upper surface of the mounting bracket 25 and pulls it down until the latch 11 approaches the keepers 18 and 19 as shown in FIG. 4. When the latch member 11 contacts the respective keeper 18, 19 (as shown in FIG. 5), the latch member 11 is deflected angularly relative to the respective mounting bracket 12 by the interengagement of the inner edge 26 of the latch member with the ramps 20 and 21 of the respective keeper 18, 19. Such angular movement of the latch member 11 relative to the mounting bracket 12 continues until the inner edge 26 of the latch member 11 reaches the lower ends of the respective ramp 20, 21 whereupon, due to the action of gravity or spring means, the latch member 11 swings back into the respective bight 22, 23 (as shown in FIG. 6) to latch the shutter in the closed condition.

Figure 8:
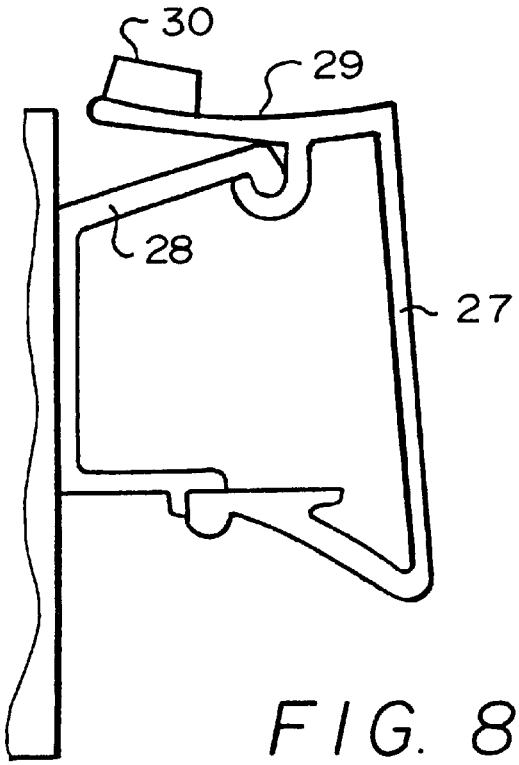
FIG. 8 illustrates an embodiment similar to that shown in FIG. 7 illustrating a sectional view of the latch member and the mounting bracket viewed from the left hand side of the shutter.

In certain embodiments, substantially as previously described and as shown in FIGS. 1 to 6, the latch member 27 (see FIG. 8) extends above and over the mounting bracket 28 to form the upper surface of the handle 29 to which the force required to close the shutter is applied. Each latch member 27 may form stops 30 on its upper surface 29.

In other embodiments (not shown) the latch member extends downwardly to envelop a or each keeper which is mounted on the structure below the opening.

What is claimed is:

1. A shutter assembly comprising:

a structure surrounding an opening, a shutter comprising a plurality of laths having fronts, backs and longitudinal edges and being hingedly connected together at their longitudinal edges and moveable across the opening in an opening direction and a closing direction, directions which are substantially normal to those longitudinal edges, a latch mechanism operable to retain the shutter in a location in which it extends across the opening, said latch mechanism comprising at least one keeper which is mounted on said structure, said at least one keeper projecting outwardly, extending away from the fronts of said laths, and comprising a first projecting portion with a first engagable surface, a handle by which the shutter can be held manually during movement of the shutter in the opening and closing directions, said handle comprising at least one movable latch member mounted on the shutter, and at least one mounting bracket, wherein said at least one latch member comprises a second projecting portion with a second engagable surface, wherein said at least one latch member can co-operate with said at least one keeper by engaging the second engagable surface of the at least one latch member with the first engagable surface of the at least one keeper to retain the shutter in said location, said at least one latch member being pivotally mounted on the shutter for pivotal movement relative to the shutter about an axis substantially parallel to the longitudinal edges of the lath, wherein during closing movement of the shutter by a closing force applied to the handle, said at least one latch member is deflected relative to the shutter when the second projecting portion engages the first projecting portion and said second projecting portion is carried past the first projecting portion whereby paid at least one latch member swings back relative to the lath into latching engagement with said at least one keeper to latch the shutter in the closed condition, and wherein during opening movement of the shutter said at least one latch member is displaced from its location of latching engagement with said at least one keeper by pivotal movement of said at least one latch member, this movement being caused by application of a shutter opening force to the handle or a portion thereof.

2. A shutter assembly according to claim 1, including resilient loading means which urge the shutter in the opening direction towards a storage location.

3. A shutter assembly according to claim 1, wherein the handle has an upper surface and an under surface and extends over substantially the full length of the lath upon which it is mounted.

4. A shutter assembly according to claim 3, wherein the or each keeper is mounted on the structure to the side of the opening, and the co-operating latch member extends laterally over the keeper.

5. A shutter assembly according to claim 3, wherein the or each keeper is mounted on the structure at the bottom of the opening, and the co-operating latch member extends below the shutter over the keeper.

6. A shutter assembly according to claim 3, wherein the upper surface of the handle is formed by said mounting bracket which is fixed to the lath, upon which mounting bracket is pivotally mounted the latch member which forms the under surface of the handle.

7. A shutter assembly according to claim 6, in which opening movement of the shutter is upwards and wherein the mounting bracket has at least one stop at its top, the stop(s) being adapted to limit upward movement of the shutter by abutting the structure at the top of the opening.

8. A shutter assembly according to claim 6, wherein the handle comprises, and said latch member and said mounting bracket at either end of the lath.

9. A shutter assembly according to claim 6, wherein the handle comprises a substantially J shaped swinging member which extends to envelop said at least one keeper mounted upon the structure to the side or bottom of the opening, the swinging member being pivotally mounted upon a respective mounting bracket being hingedly connected together at their co-operating longitudinal edges.

10. A shutter assembly according to claim 6, wherein the mounting bracket has a stop surface which limits pivotal movement of the latch member relative to the lath on which it is mounted.

11. A shutter assembly according to claim 10, wherein the mounting bracket forms two stop surfaces which respectively limit pivotal movement of the latch member in either direction.

12. A shutter assembly according to claim 1, wherein the latch member envelopes the mounting bracket thereby forming both an upper and lower surface of the handle.

13. A shutter assembly according to claim 12, in which opening movement of the shutter is upwards and wherein the latch member has at least one stop at its top, the stop(s) being adapted to limit upward movement of the shutter by abutting the structure at the top of the opening.

* * * * *